US006457616B2

(12) United States Patent
Gagne

(10) Patent No.: US 6,457,616 B2
(45) Date of Patent: Oct. 1, 2002

(54) BELTCLIP MOUNTED BEVERAGE HOLDER

(76) Inventor: Ronald G. Gagne, 495 Whiting St., Hanover, MA (US) 02339

( * ) Notice: Subject to any disclaimer, the term of this patent is extended or adjusted under 35 U.S.C. 154(b) by 0 days.

(21) Appl. No.: 09/767,743

(22) Filed: Jan. 24, 2001

Related U.S. Application Data

(60) Provisional application No. 60/178,735, filed on Jan. 28, 2000.

(51) Int. Cl.[7] ..... A45F 5/00

(52) U.S. Cl. ..... 224/148.4; 224/148.5; 224/148.7; 224/197; 224/271

(58) Field of Search ..... 224/148.1, 148.3, 224/148.4, 148.5, 148.7, 197, 199, 669, 271, 272, 547, 904

(56) References Cited

U.S. PATENT DOCUMENTS 2,138,978 A * 12/1938 Meine ..... 224/272
3,065,944 A * 11/1962 Liebendorfer ..... 215/11.6
3,434,638 A * 3/1969 Beynon ..... 124/25.7
4,269,338 A 5/1981 Sichel
4,708,273 A 11/1987 Grant
4,830,247 A * 5/1989 Banks ..... 211/70.6
4,867,358 A * 9/1989 Bennis ..... 224/148.3
4,951,857 A * 8/1990 Carr ..... 211/65
4,955,572 A * 9/1990 Simmons ..... 224/148.2
5,375,749 A * 12/1994 Oliva ..... 224/242
5,740,951 A 4/1998 Jack
5,857,601 A * 1/1999 Greenwood ..... 224/409
6,045,017 A * 4/2000 Connell ..... 224/148.4
6,283,345 B1 * 9/2001 Butschat ..... 224/148.4

* cited by examiner

*Primary Examiner*—Gregory M. Vidovich
(74) *Attorney, Agent, or Firm*—Richard C. Litman

(57) ABSTRACT

A beltclip-mounted holder assembly allows for the hands-free carrying of a beverage container. The body portion of the holder assembly comprises a plate having a spring-loaded clip used to attach the holder assembly to a person's belt or waistband. A pivotally mounted bracket located near the base of the plate allows a receptacle to move in a pendular manner. The receptacle is insulated and is designed to support a beverage container therein.

20 Claims, 3 Drawing Sheets

BELTCLIP MOUNTED BEVERAGE HOLDER

CROSS-REFERENCE TO RELATED APPLICATION

This application claims the benefit of U.S. Provisional Patent Application Serial No. 60/178,735, filed Jan. 28, 2000.

BACKGROUND OF THE INVENTION

1. Field of the Invention

The present invention generally relates to beverage holders. and more particularly, to a free-hanging beverage container holder assembly that easily and conveniently attaches to a person's belt. The beverage holder employs a spring loaded clip to securely fasten the beverage holder to the belt.

2. Description of Related Art

Enjoying a refreshing beverage is frequently hampered by the need to place the beverage in a convenient location while the consumer is not drinking. If the consumer is moving around from one location to another and leaves the beverage behind, it becomes necessary to return to the location where the beverage was left each time he/she wishes to imbibe. This scenario is both inconvenient and time consuming.

In public areas (shopping malls, amusement parks, etc.) the usual practice forces the consumer to hand-carry a beverage, which is awkward, restrictive, and potentially messy should the beverage spill. Furthermore, hand-carrying a beverage requires the constant attention of the person carrying the drink, therefore, the enjoyment of any activity is greatly diminished.

The prior art describes a number of clothes-attachable holders that are used to hold a variety of items. For example, a ball holder is described in U.S. Pat. No. 4,269,338, issued on May 26, 1981 to B. F. Sichel. The ball holder is capable of retaining one or two balls and can be easily attached to a person's clothing. The ball holder consists of a vertical strut member, an upper planar ball retaining member extending outwardly from the upper edge of the strut member, a lower planar ball retaining member extending outwardly from the lower edge of the strut member, and a cylindrical ball retaining member joined to the central portion of the strut member and lying between the upper and lower planar ball retaining members.

U.S. Pat. No. 4,708,273, issued on Nov. 24, 1987 to B. T. Grant, describes a container holder that is attachable to a person's belt. The container holder can support an open drink container in an upright position so that the container can be removed to consume its contents. The holder consists of a structure for receiving an open drink container in a supporting relationship so that the container is maintained in a substantially upright position and can be withdrawn to consume a drink, and a structure for attaching the container receiving structure to a belt.

An insulated belt-attached beverage can holder is described in U.S. Pat. No. 5,740,951, issued on Apr. 21, 1998 to J. Jack. The beverage can holder consists of a receptacle unit, a receptacle lid unit, a belt clip unit, and a tether/hinge unit. The belt clip is operatively attached to the beverage receptacle unit and the tether/hinge unit forms the operative attachment between the receptacle unit and the receptacle lid unit. The tether/hinge unit also provides an auxiliary belt retention member should the belt clip unit be dislodged from the belt or experience a structural failure.

None of the above inventions and patents, taken either singly or in combination, is seen to disclose the instant invention as will subsequently be described and claimed.

SUMMARY OF THE INVENTION

The present invention comprises a hands-free holder assembly which supports a beverage container in an easily accessible location. The holder assembly of the present invention employs a spring loaded clip to fasten and secure the body portion of the holder to a person's belt or waistband. A pivotally mounted bracket disposed near the base of the body portion receives a beverage container. The bracket is designed to assume a pendular motion which, allows the wearer of the holder assembly to move about in an unrestricted manner.

The holder assembly comprises an irregular shaped body portion and a detachable receptacle. The receptacle has a posteriorly-disposed, elongated handle or clip that inserts into a slot defined in the pivotally mounted bracket. The structural integrity of the receptacle is maintained by a plastic sub-frame or skeleton. The receptacle has an expandable neoprene or "koozie" type body which serves to keep hot beverages hot and cold beverages cold.

Accordingly, it is a principal object of the invention to provide a holder assembly for a beverage container that is convenient and easy to use.

It is another object of the invention to provide a holder assembly which functions to maintain the temperature of the beverage either hot or cold.

It is a further object of the invention to provide a holder assembly for a beverage container, which holder assembly is easily secured to a person's belt or waistband.

Still another object of the invention is to provide a holder assembly for a beverage container, which holder assembly can accommodate different beverage container sizes.

It is an object of the invention to provide improved elements and arrangements thereof for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
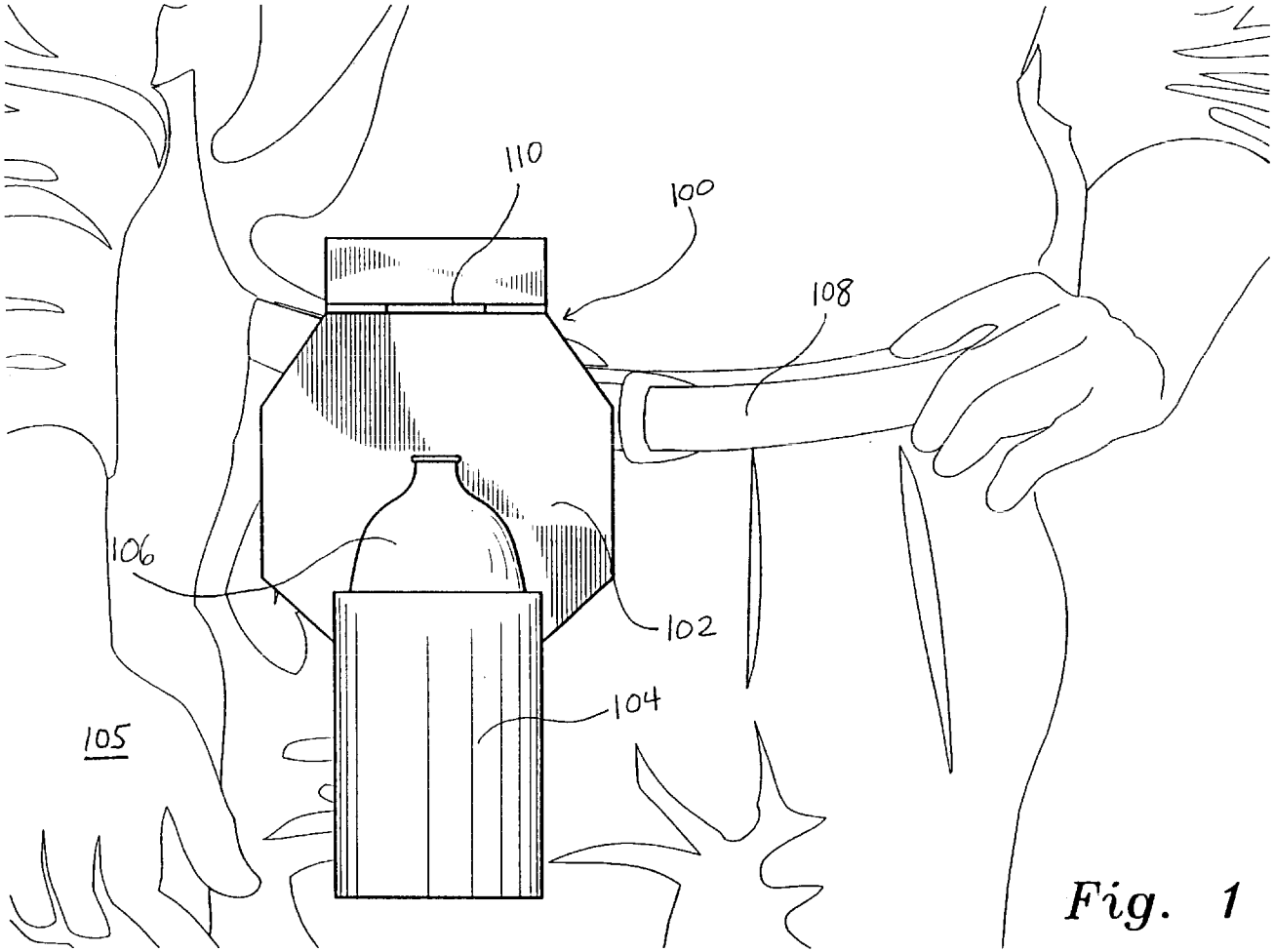
FIG. 1 is an environmental, front view of a beltclip-mounted holder assembly according to the present invention.
Figure 2:
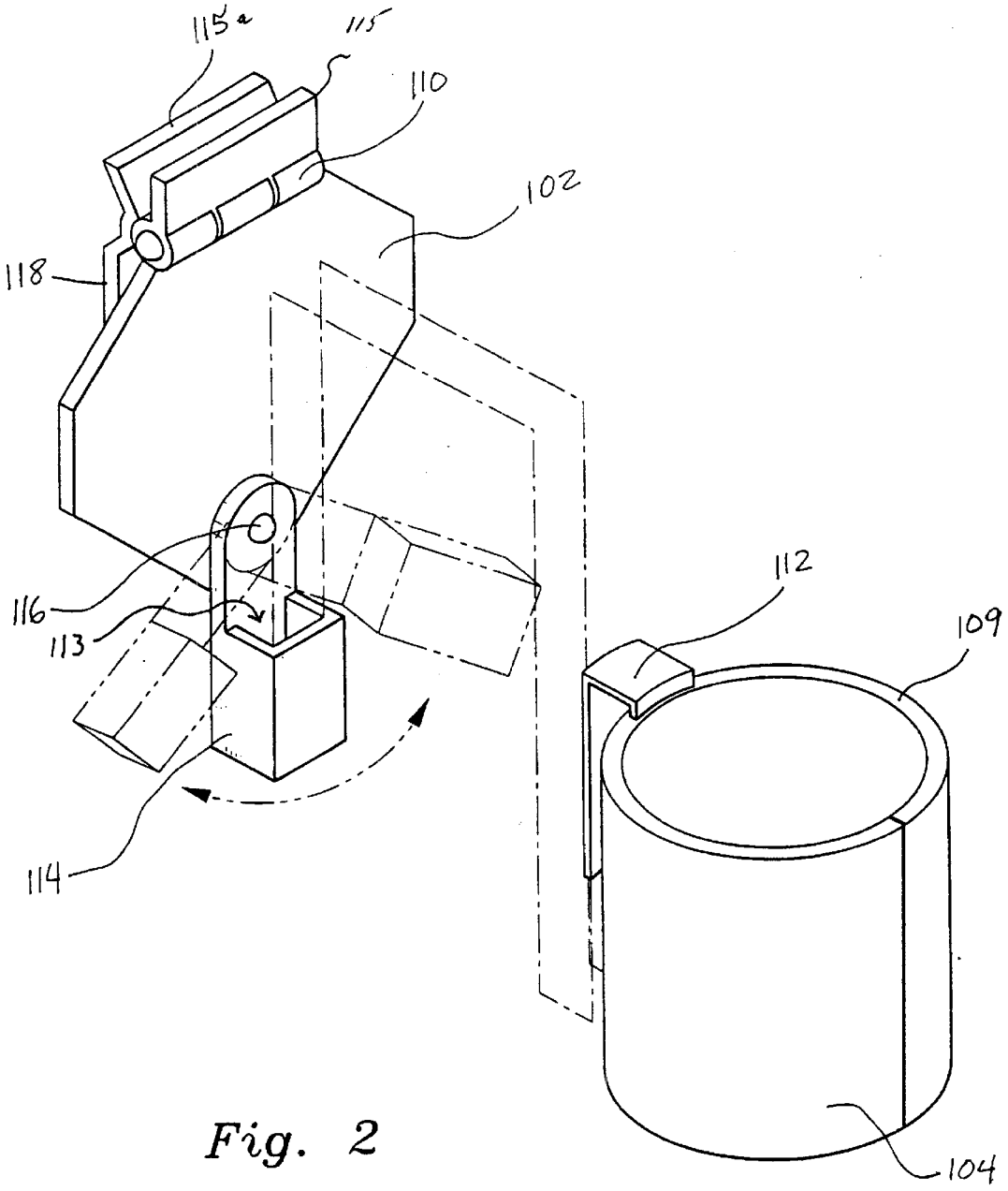
FIG. 2 is an exploded perspective view of the holder assembly according to the present invention.
Figure 3:
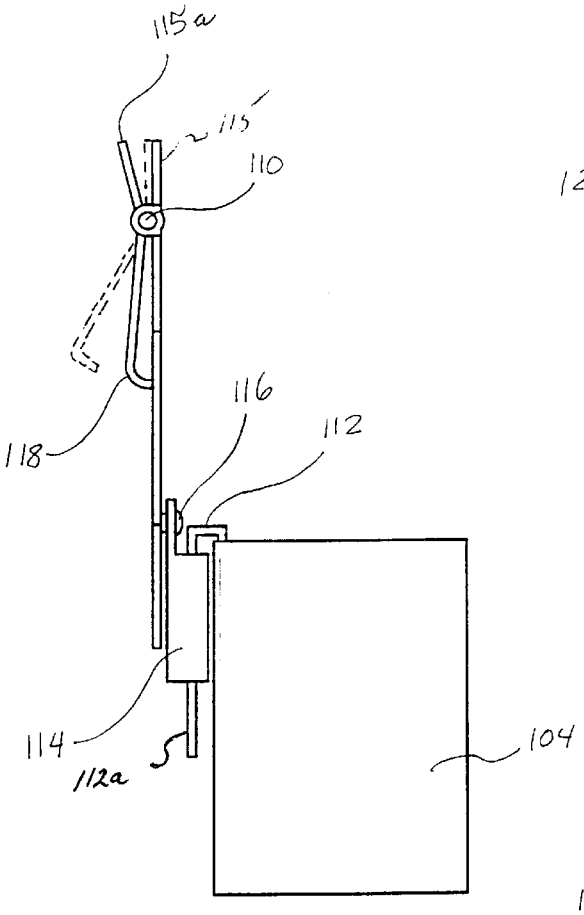
FIG. 3 is a side view of the holder assembly according to the present invention.

The present invention, as depicted in FIGS. 1–3, 4A, and 4B, is a beltclip mounted holder assembly, generally indicated at 100, for holding a beverage container 106. As best seen in FIG. 1, holder assembly 100 is mounted on belt 108 and supports beverage container 106 therein. Holder assembly 100 conveniently attaches to belt 108 (or waistband) by way of a spring-loaded clip 118 (FIG. 2 and 3). Beverage container 106 is within easy grasp of a person's hand 105. As indicated above, the hands-free holder 100 frees a user from the tedious and laborious task of continuously holding a container 106.

Attention is now directed to FIGS. 2 and 3 which illustrate a more detailed showing of holder assembly 100. Holder assembly 100 comprises a flat plate 102 which may be fabricated from any suitable material (plastic, metal, etc.). Although shown as polygonal, plate 102 may assume any desired configuration. A hinge 110 is fixed at the top end of plate 102. Hinge 110 is provided, with respective front and rear heads 115, 115*a*. A clip 118 is spring-loaded to hinge 110 and extends downward a pre-determined length along the rear surface of plate 102. The pre-determined length of clip 118 will be at least equal to the width of a standard size belt. A pin 116 is fixed on the lower front surface of plate 102. A bracket 114 is pivotally attached to pin 116 such that bracket 114 may freely move in a pendular fashion. Bracket 114 is provided with a slot 113 for a purpose which will be explained below.

Figure 4B:
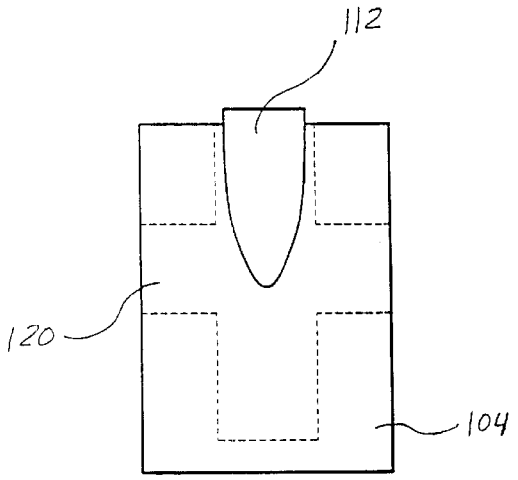
FIG. 4B is a rear view of the beverage container receptacle showing the outline of a plastic sub-frame according to the present invention.
Figure 4A:
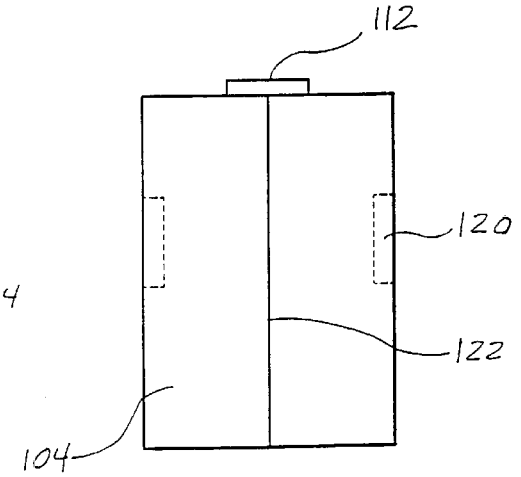
FIG. 4A is a front view of a beverage container receptacle showing an expandable joint according to the present invention.

Holder assembly 100 is provided with a detachable beverage container receptacle 104. Receptacle 104 has a neoprene body or exterior 109 disposed on a plastic endoskeleton or sub-frame 120 (FIG. 4B). The neoprene body 109, which functions to insulate container 106, may be mounted on sub-frame 120 in any convenient and efficient manner (sewing and the like). A vertical expansion joint 122 (FIG. 4A) is formed in body 109 to allow the body to expand and accommodate different container sizes. The body 109 is generally cylindrical with an open top. The plastic sub-frame 120 has a substantially vertical support band integral with a substantially horizontal, semi-cylindrical support band. An elongated clip 112 is fixed to the top of body 109 at a point diametrically opposite to expansion joint 122. Clip 112 is provided with a free end 112*a* which is spaced a slight distance from the exterior surface of body 109.

In use, the plate 102 is engaged to a wearer's belt merely by pressing heads 115, 115*a* to pivot clip 118 away from the rear surface of the plate. Clip 112 is inserted into slot 113 defined in bracket 114 such that receptacle 104 is pivotally mounted at the base of plate 102. As indicated above, the pivoted bracket 114 allows receptacle 104 to move with a pendular motion which, in turn, permits the wearer to insert beverage container 106 therein and move around in an unrestricted manner.

This modular construction allows for easy cleaning of the holder assembly 100. Furthermore, only plate 102 or receptacle 104 need be replaced if either is damaged or wears out. Thus, a person can take a drink of his/her favorite beverage, insert the beverage into the receptacle, and have his/her hands free for various activities while his/her beverage remains cold/warm and close at hand.

The preferred embodiment of the present invention disclosed herein are intended to be illustrative only and are not intended to limit the scope of the invention. It should be understood by those skilled in the art that various modifications and adaptations of the present invention, as well as alternative embodiments of the present invention may be contemplated. It is to be understood that the present invention is not limited to the sole embodiment described above, but encompasses any and all embodiments within the scope of the following claims.

I claim:

1. A beverage holder that mounts directly onto a user's belt comprising:

a body member, said body member having a top end, a bottom end, a front face and a rear face;

first means for mounting said body member onto a user's belt, said first means being attached at said top of said body member;

a receptacle;

second means for suspending said receptacle from said body member, said second means being attached on said front face of said body member; and an elongated clip attached to said receptacle, said elongated clip spaced from and extending along an exterior surface of said receptacle and terminating at a free end; wherein, said second means includes a bracket having a slot formed therein, said bracket being pivotally mounted to said front face of said body member, said slot adapted to receive said free end of said elongated clip, said receptacle being substantially larger than said bracket.

2. A beverage holder as recited in claim 1, wherein said body member is a flat plate having a polygonal configuration.

3. A beverage holder as recited in claim 2, wherein said first means includes a hinge member attached at the top of said flat plate.

4. A beverage holder as recited in claim 3, wherein said first means includes a spring-loaded clip, said spring-loaded clip connected to said hinge member and extending along said rear face of said body member.

5. A beverage holder as recited in claim 4, wherein said receptacle comprises a member having a cylindrical wall and an open top, said cylindrical wall being fabricated from an insulating material.

6. A beverage holder as recited in claim 5, wherein said insulating material is neoprene.

7. A beverage holder as recited in claim 6, wherein said cylindrical wall has a vertically oriented, expandable joint disposed therein.

8. A beverage holder as recited in claim 7, wherein said elongated clip is attached to said cylindrical wall adjacent said open top, said elongated clip spaced from and extending along an exterior surface of said cylindrical wall.

9. A beverage holder as recited in claim 8, wherein said second means further includes a pin attached to said front face of said body member for pivotally mounting said bracket.

10. A beverage holder as recited in claim 9, wherein said body member is made of plastic.

11. A beverage holder as recited in claim 9, wherein said body member is made of metal.

12. A beverage holder comprising:

a body portion;

a spring-loaded clip, said spring-loaded clip attached to said body portion and adapted to mount said body portion to a belt;

a bracket, said bracket having a slot formed therein;

first means for pivotally mounting said bracket to said body portion;

a cylindrical receptacle, said receptacle having a vertically disposed expandable joint; and second means for removably mounting said receptacle on said bracket.

13. A beverage holder as recited in claim 12, wherein said first means is a pin attached to said body portion.

14. A beverage holder as recited in claim 13, wherein said second means is an elongated clip mounted on said receptacle.

15. A beverage holder as recited in claim 14, wherein said body portion is a flat plate having a polygonal configuration.

16. A beverage holder as recited in claim 15, wherein said cylindrical receptacle has an open top, said cylindrical receptacle being fabricated from an insulating material.

17. A beverage holder as recited in claim 16, wherein said cylindrical receptacle is disposed on a plastic sub-frame.

18. A beverage holder as recited in claim 17, wherein said insulating material is neoprene.

19. A beverage holder as recited in claim 18, wherein said body portion is made of plastic.

20. A beverage holder as recited in claim 18, wherein said body portion is made of metal.

* * * * *